US005939692A

United States Patent [19]

Perret

[11] Patent Number: 5,939,692

[45] Date of Patent: Aug. 17, 1999

[54] GAS-FILLED INTERRUPTER WITH COMPRESSIBLE THERMAL EXPANSION CHAMBER

[75] Inventor: Michel Perret, Bourgoin-Jallieu, France

[73] Assignee: GEC Alsthom T & D SA, Paris, France

[21] Appl. No.: 09/120,506

[22] Filed: Jul. 23, 1998

[30] Foreign Application Priority Data

Jul. 24, 1997 [FR] France ..... 97 09419

[51] Int. Cl.[6] ..... H01H 33/18; H01H 33/70; H01H 33/82

[52] U.S. Cl. ..... 218/43; 218/59; 218/62

[58] Field of Search ..... 218/43, 45, 48, 218/49, 50, 51, 52, 53, 54, 55, 59, 60, 61, 62, 63, 64, 72, 73

[56] References Cited

U.S. PATENT DOCUMENTS

| | | | |
|---|---|---|---|
| 4,754,109 | 6/1988 | Thuries et al. | 200/148 A |
| 5,248,862 | 9/1993 | Blatter | 200/148 A |

FOREIGN PATENT DOCUMENTS

| | | |
|---|---|---|
| 0508160A2 | 10/1992 | European Pat. Off. . |
| 0591039A1 | 4/1994 | European Pat. Off. . |
| 0641002A1 | 3/1995 | European Pat. Off. . |
| 0664552A1 | 7/1995 | European Pat. Off. . |
| 2491675 | 4/1982 | France . |
| 3930548A1 | 3/1991 | Germany . |

*Primary Examiner*—Lincoln Donovan
*Attorney, Agent, or Firm*—Sughrue, Mion, Zinn, Macpeak & Seas, PLLC

[57] ABSTRACT

A compressed gas interrupter comprises two contact assemblies each including at least one wear contact and one of which is mobile along an axis relative to the other, which is fixed. The mobile contact assembly is moved along the axis by an insulative maneuvering rod and has a gas compression chamber which, in the open position, communicates via an insulative nozzle with an expansion chamber. The compression chamber includes a piston attached to the hollow wear contact of the mobile contact assembly and which slides in a cylinder attached to the maneuvering rod, the cylinder delimiting the compression chamber with the piston and the nozzle. The hollow wear contact is mobile relative to the maneuvering rod. A system using balls immobilizes the hollow wear contact during initial travel of the maneuvering rod to open the interrupter and constrains the hollow wear contact to move with the maneuvering rod at the end of its travel.

4 Claims, 3 Drawing Sheets

GAS-FILLED INTERRUPTER WITH COMPRESSIBLE THERMAL EXPANSION CHAMBER

BACKGROUND OF THE INVENTION

1. Field of the Invention

The invention concerns a compressed gas interrupter comprising two contact assemblies each having at least one wear contact and one of which is mobile along an axis relative to the other which is fixed and in which the wear contact of the fixed contact assembly is in the form of a rod and in the closed position is inserted into the hollow wear contact of the mobile contact assembly which is moved along the axis by an insulative maneuvering rod. The invention further includes a gas compression chamber which in the open position communicates via an insulative nozzle with an expansion chamber, the nozzle being coaxial with the two contact assemblies and fixed to the mobile contact assembly so that in the closed position the wear contact of the fixed contact assembly passes through it.

2. Description of the Prior Art

An interrupter of the above kind, which can be used as a high-voltage or medium-voltage gas-insulated or air-insulated circuit-breaker or isolator, is described in patent application FR-9211588. In this prior art interrupter the compression chamber that in the open position of the interrupter communicates via the neck of the nozzle with the expansion chamber is a constant volume thermal compression chamber. The gas which blows out the arc is compressed by a piston disposed in another compression chamber of variable volume to the rear of the thermal compression chamber relative to the nozzle. The piston compression chamber and the thermal compression chamber communicate with each other via check valves in a wall separating the two chambers. In the above prior art construction it is therefore necessary to delimit two gas compression chambers and to provide valves for communication between the two chambers.

The aim of the invention is to propose a solution to the above problem by simplifying the construction of an interrupter of the above kind, and in particular to reduce the number of parts constituting it.

This object is achieved by an interrupter which includes a compressible variable volume thermal compression chamber.

SUMMARY OF THE INVENTION

In a gas-filled interrupter of the present invention a piston fastened to the hollow wear contact is adapted to slide in a cylinder attached to the maneuvering rod. The cylinder delimits the compression chamber with the piston and the nozzle, the hollow wear contact is mobile relative to the maneuvering rod along the axis, and locking means are provided for immobilizing the hollow wear contact in the lengthwise direction of the axis during initial travel of the maneuvering rod between the closed position and the open position and to constrain the hollow wear contact to move with the maneuvering rod at the end of the travel of the latter.

Accordingly, at the beginning of opening of the interrupter, the maneuvering rod moves the cylinder with the nozzle along the axis but the piston remains fixed in position lengthwise of the axis. The nozzle and the piston therefore move closer together which compresses the gas in the cylinder delimiting the compression chamber, the wear contact of the fixed contact assembly passing through and therefore shutting off the nozzle, which prevents the compressed gas from escaping into the expansion volume V. When the maneuvering rod becomes attached to the wear contact of the mobile contact assembly, the wear contact of the fixed contact assembly disengages from the wear contact of the mobile contact assembly and from the nozzle, enabling communication between the compression chamber and the expansion chamber via the neck nozzle.

An arrangement of the above kind therefore requires only one compression chamber with a combination of thermal and piston operation and an interrupter is obtained comprising a small number of parts, which facilitates its assembly.

An arrangement of the above kind also avoids the usual head losses due to transfer of gas from the piston compression chamber to the thermal compression chamber. In the arrangement in accordance with the invention, there is no dead volume at the end of compression by the piston. The arrangement of the invention offers improved control of thermal compression.

One embodiment of the invention is described in more detail hereinafter and shown in the drawings.

DETAILED DESCRIPTION OF THE PREFERRED EMBODIMENT

Figure 1:
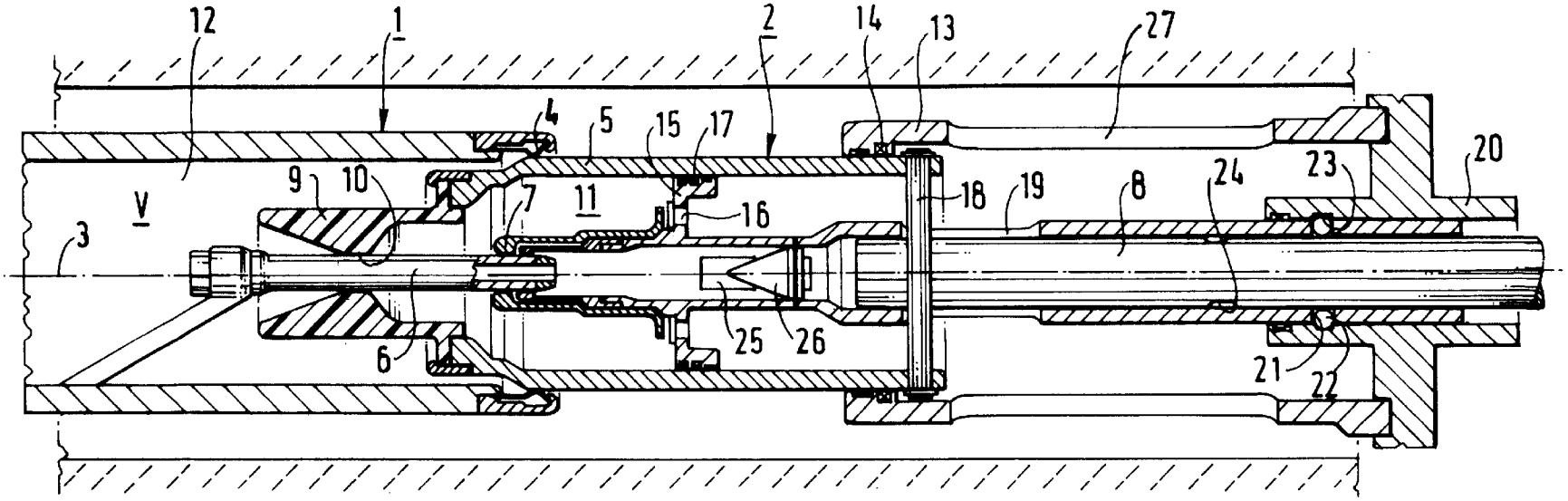
FIG. 1 is a diagrammatic illustration of a compressed gas interrupter of the invention in its closed position.

The figures, and more especially FIG. 1, show two contact assemblies 1, 2 in a jacket (not shown) filled with a dielectric gas for extinguishing the electrical arc. The contact assemblies can be engaged one within the other or disengaged from each other along a longitudinal axis 3 by maneuvering a control mechanism.

the contact assemblies 1 and 2 each have a respective permanent current contact 4 and 5 and a respective wear or arc contact 6 and 7 which are electrically connected to an electrical connection (not shown). These various contacts are essentially circular and essentially tubular, making the assembly highly compact.

The contact assembly 2 is mobile and can be slid along the axis 3 inside the jacket by an insulative maneuvering rod 8 which is maneuvered from outside the unit and which extends along the axis 3. It includes an insulative nozzle 9 with a neck 10 which blows out the electrical arc in the manner well known in the art. In the closed position the nozzle 9 is disposed coaxially between the contact 4 and the contact 6. It is fixed to the cylinder forming the contact 5 and the wear contact 6 in the form of a rod passes through its neck 10. The wear contact 6 is in turn inserted in the hollow wear contact 7.

The contact assembly 2 also includes a thermal compression chamber 11 defined by the cylinder forming the contact 5. The compression chamber 11 accumulated the compressed gas and communicates with an expansion volume V of an expansion chamber 12 via the nozzle 9 when the war contact 6 is disengaged from the nozzle 9 when the interrupter is tripped.

The cylinder constituting the contact 5 slides in a cylindrical metal guide tube 13 which is fixed into the unit along the axis 3. It is surrounded by a sliding contact 14 mounted inside the tube 13 and through which current passes between the tube 13 and the contact 5.

A metal ring 15 which extends radially in the cylinder forming the permanent current contact 5 is fixed to the wear contact 7 and constitutes a piston for compressing the gas in the compression chamber 11. The ring or compression piston 15 includes one or more check valves enabling gas to enter the chamber 11 from the volume to the rear of the ring 15 (to the right in the figures) on arming the interrupter. The volume of the compression chamber 11 can therefore be compressed and is delimited by the cylinder 5, the nozzle 9 and the piston.

The ring 15 is further surrounded by a sliding contact 17 which is mounted in the cylinder 5 to conduct the current from the cylinder to the wear contact 7.

A rigid connecting rod 18 which is advantageously clipped to the cylinder 5 at both ends passes through the maneuvering rod 8 to attach it to the rod. The rod 18 also passes radially through a longitudinal slot 19 in a tubular extension of the wear contact 7, the maneuvering rod 8 sliding along the axis 3 inside the tubular extension of the wear contact 7. The connecting rod 18 can therefore slide a certain distance along the axis 3 in the slot 19, entraining the cylinder 5, while the tubular extension of the wear contact 7 remains fixed in position lengthwise of the axis 3.

The tubular extension of the wear contact 7 slides along the axis 3 in another tube 20 fixed along the axis 3 and acting as a guide and support.

The tubular extension of the wear contact 7 includes one or more lateral orifices 21 accommodating locking balls 22 which engage in respective recesses 23 and 24 in the tube 20 and in the maneuvering rod 8. The distance between the recesses 23 and 24 along the axis 3 is significantly less than the length of the slot 19 in the tubular extension of the wear contact 7.

The tubular extension of the wear contact 7 also has one or more gas exhaust openings 25 substantially to the rear of the piston (on the right in the figures) and an ogival gas deflector 26.

In the closed position (FIG. 1) the wear contact 6 is inserted in the hollow wear contact 7 and passes through the insulative nozzle 9. Consequently the compression chamber is closed. The ball(s) 22 are engaged in the opening(s) 23 in the fixed tube 20 with the result that the tubular extension of the wear contact 7 and therefore the piston are immobilized lengthwise of the axis 3. The current flows from the tube 13 to the permanent current contact 5 via the sliding contacts 14 and to the permanent current contact 4.

Figure 2:
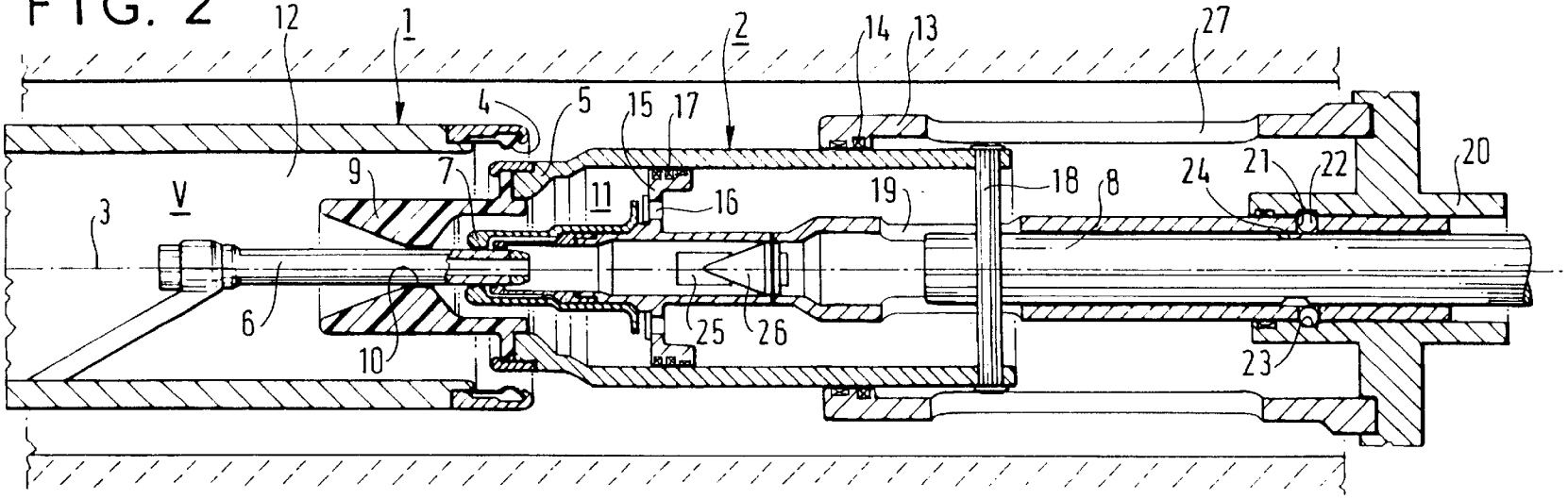
FIG. 2 is a schematic illustration of the interrupter from FIG. 1 in a first intermediate position between its closed position and its open position.

During opening of the interrupter (FIG. 2) the maneuvering rod 8 moves a certain distance to the right in FIG. 2. It entrains the connecting rod 18 and therefore the cylinder 5 with the nozzle 9 in this direction. The permanent current contacts 5 and 4 are separated. The wear contacts 7 and therefore the piston remain immobile lengthwise of the axis 3 because of the locking effect of the ball(s) 22 in the recess(es) 23 in the fixed tube 20. The wear contact 6 therefore remains inserted in the wear contact 7 and the current flows from the tube 13, to the cylinder 5 and then to the piston via the sliding contact 17, to the wear contact 7, to the wear contact 6 which is connected to the permanent current contact 4. Movement of the maneuvering rod causes the nozzle 9 and the piston to move towards each other and consequently reduces the volume of the compression chamber 11. The gas inside the compression chamber is therefore compressed.

Figure 3:
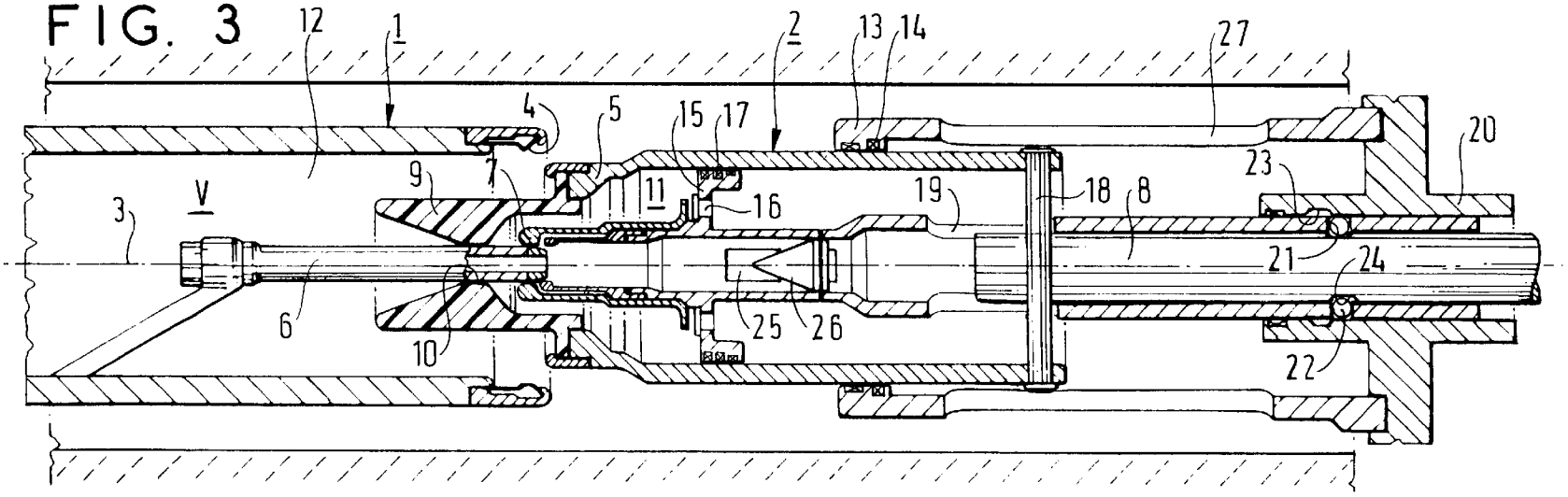
FIG. 3 is a schematic illustration of the interrupter from FIG. 1 in a second intermediate position between its closed position and its open position.

In FIG. 3 the maneuvering rod 8 continues its movement towards the right and at a particular moment the recesses 24 in the maneuvering rod line up with the ball(s) 22. Because of the forces exerted on the ball(s), they engage in the recesses 24 and release the recesses 23. The relative immobilization of the tube 20 and the tubular extension of the wear contact 7 is now transferred to the maneuvering rod 8 and the tubular extension of the wear contact 7.

Figure 4:
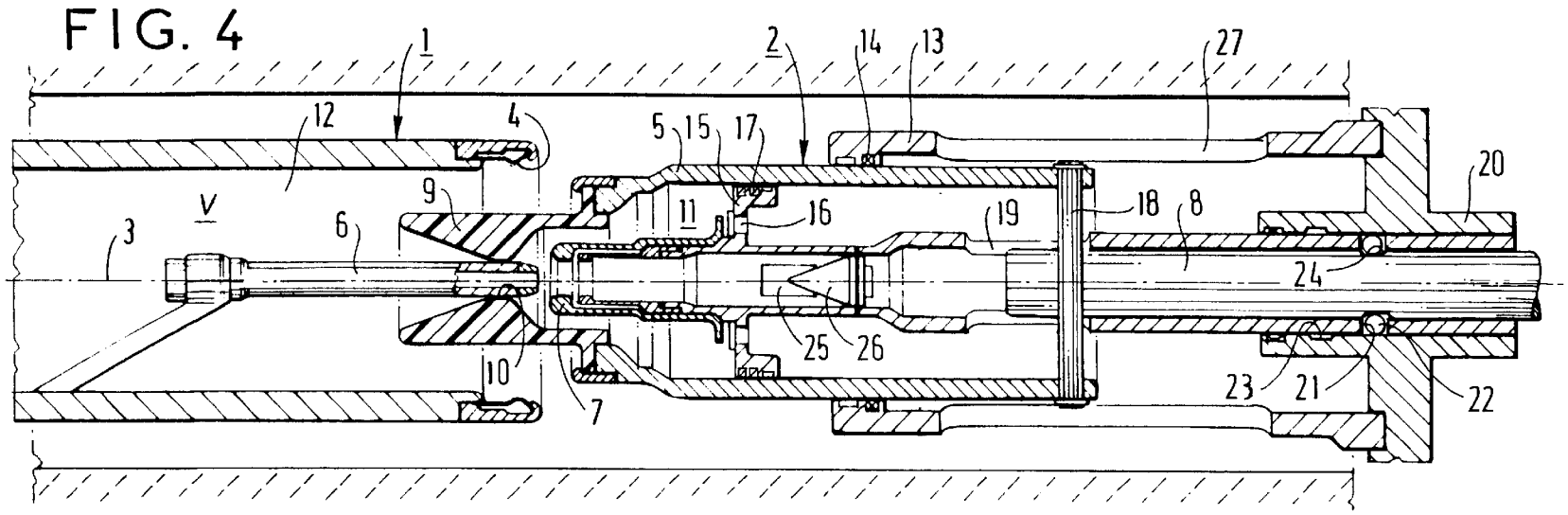
FIG. 4 is a schematic illustration of the interrupter from FIG. 1 in a third intermediate position between its closed position and its open position.

In FIG. 4 the maneuvering rod 8 continues its movement towards the right and now entrains the mobile contact assembly 2, namely the cylinder 5 with the nozzle 9 and the wear contact 7 with the piston. The wear contacts 7 and 6 are separated first and an electrical arc is struck between these two contacts. The wear contact 6 still passes through the nozzle 9, which isolates the expansion chamber 12 from the compression chamber 11. The pressure of the pressurized gas in the compression chamber 11 rises further because of the effect of the electrical arc and this gas escapes towards the interior of the hollow wear contact 7, which blows out the electrical arc. It escapes from the hollow wear contact 7 via the lateral openings 25, the flow of gas being guided by the ogival deflector 26, and then escapes via the open end of the cylinder 5 to the rear of the piston and the lateral openings 27 in the tube 13. The flow of the gases contributing to this first blowing out of the arc is symbolized by arrows.

Figure 5:
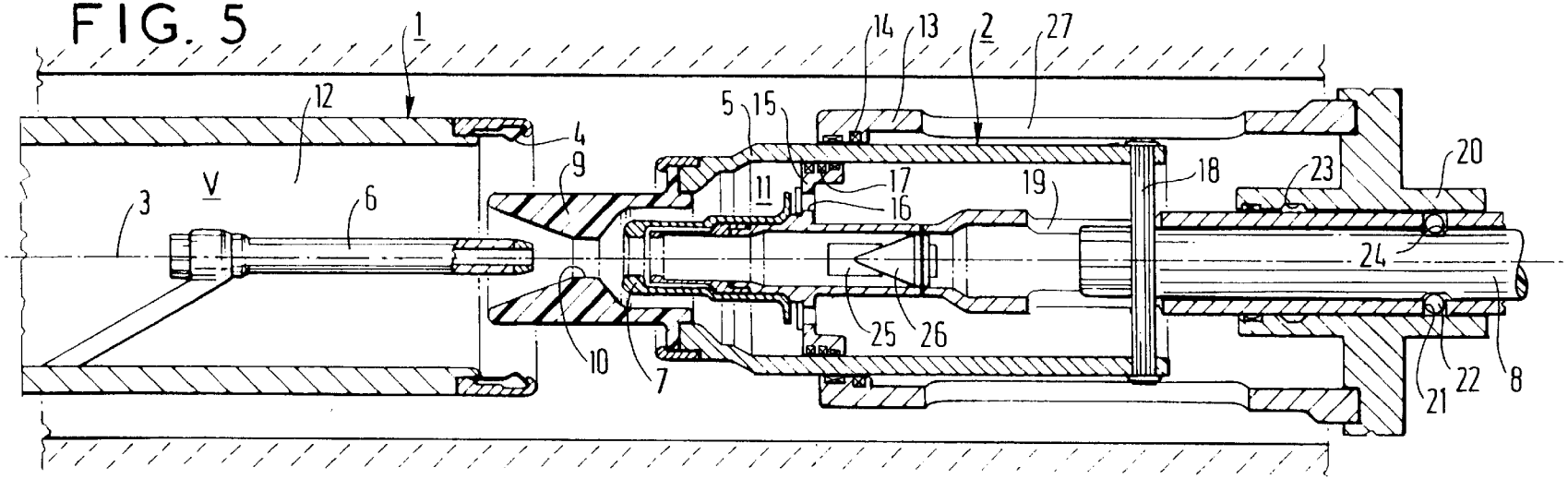
FIG. 5 is a schematic illustration of the interrupter from FIG. 1 in its fully open position.

In FIG. 5 the maneuvering rod has reached the end of its travel. The wear contact 6 is now completely disengaged from the nozzle 9 and the residual pressurized gas in the compression chamber 11 is evacuated via the neck 10 of the nozzle 9 and blows out the electrical arc as again shown by arrows.

When the interrupter is armed, starting from the open position shown in FIG. 5, the maneuvering rod moves towards the left in the figures and the locking balls 22 operate in the opposite manner.

Note that the distance between the recesses 23 and 24 along the axis 3 conditions the magnitude of compression by the piston in the compression chamber 11. The thermal compression of the gas in the chamber 11 is effected at constant volume with no head loss. An arrangement of the above kind achieves double blowing out of the electrical arc for interrupting large currents or capacitive currents with low maneuvering energy.

There is claimed:

1. A compressed gas interrupter comprising:

two contact assemblies each having at least one wear contact, one contact assembly being mobile along an axis relative to the other contact assembly being fixed, wherein the wear contact of the fixed contact assembly is in the form of a rod and the wear contact of the mobile contact assembly is in the form of a hollow wear contact, wherein in a closed position the rod of the fixed contact assembly is inserted into the hollow wear contact of the mobile contact assembly which is moved along the axis by an insulative maneuvering rod; and a gas compression chamber which in the open position communicates via an insulative nozzle with an expansion chamber, said nozzle being coaxial with said two contact assemblies and fixed to the mobile contact assembly so that in the closed position the rod of the fixed contact assembly passes through said nozzle, wherein a piston fastened to said hollow wear contact is adapted to slide in a cylinder attached to said maneuvering rod, said cylinder delimiting said compression chamber with said piston and said nozzle, said hollow wear contact being mobile relative to said maneuvering rod along said axis, and locking means being provided for immobilizing said hollow wear contact in the lengthwise direction of the axis during initial travel of said maneuvering rod between a closed position and an open position and to constrain said hollow wear contact to move with said maneuvering rod at the end of the travel of said maneuvering rod.

2. The interrupter claimed in claim 1 wherein said maneuvering rod is slidably mounted in a tubular extension of said hollow wear contact and said locking means comprise at least one ball mobile in a lateral orifice in said tubular extension of said hollow wear contact, said ball being adapted to be engaged alternately in a first recess in a tube disposed coaxially around said tubular extension of said hollow wear contact and in a second recess in said maneuvering rod.

3. An interrupter as claimed in claim 2 including a connecting rod passing radially through said maneuvering rod and fixed at its ends to said cylinder, said connecting rod passing radially through a longitudinal slot in said tubular extension of said hollow wear contact.

4. The interrupter claimed in claim 3 wherein said longitudinal slot in said tubular extension of said hollow wear contact extends along said axis a distance slightly greater than the distance along said axis between a recess in said maneuvering rod and a recess in said tube surrounding said tubular extension of said hollow wear contact.

* * * * *